US005406969A

United States Patent [19]

Gray et al.

[11] Patent Number: 5,406,969

[45] Date of Patent: Apr. 18, 1995

[54] REGULATION OF FLOWRATE OF LIQUID FURNACE PRODUCTS

[75] Inventors: Neil B. Gray, North Balwyn; John S. Pitsillos, North Melbourne, both of Australia

[73] Assignee: The University of Melbourne, Australia

[21] Appl. No.: 104,152

[22] PCT Filed: Feb. 18, 1992

[86] PCT No.: PCT/AU92/00059

§ 371 Date: Aug. 17, 1993

§ 102(e) Date: Aug. 17, 1993

[87] PCT Pub. No.: WO92/14980

PCT Pub. Date: Sep. 3, 1992

[30] Foreign Application Priority Data

Feb. 18, 1991 [AU] Australia ..... PK4655

[51] Int. Cl.[6] ..... F17D 1/16; F15C 1/04

[52] U.S. Cl. ..... 137/13; 137/340; 137/828

[58] Field of Search ..... 137/340, 13, 827, 828

[56] References Cited

U.S. PATENT DOCUMENTS 2,714,622 8/1955 McMullen .
4,392,509 7/1983 Siddall .
5,002,480 3/1991 Gellert et al. ..... 137/340

FOREIGN PATENT DOCUMENTS 1527380 4/1968 France .
1131614 10/1968 United Kingdom .
1490355 11/1977 United Kingdom .
1497963 1/1978 United Kingdom .

*Primary Examiner*—A. Michael Chambers
*Attorney, Agent, or Firm*—Andrus, Sceales, Starke & Sawall

[57] ABSTRACT

The invention relates to an apparatus and method for regulating the flow rate of a liquid furnace product. The apparatus comprises a heat exchange jacket (10) surrounding a conduit (9) through which liquid furnace products flow. The heat exchange jacket (11) removes sufficient heat from the conduit and product flowing therein to cause a shell of solidified product to form on the internal surface of the conduit. The flow rate in the conduit is controlled by regulating the coolant flow through the heat exchange jacket and consequent shell thickness.

15 Claims, 5 Drawing Sheets

REGULATION OF FLOWRATE OF LIQUID FURNACE PRODUCTS

FIELD OF THE INVENTION

Figure 1:
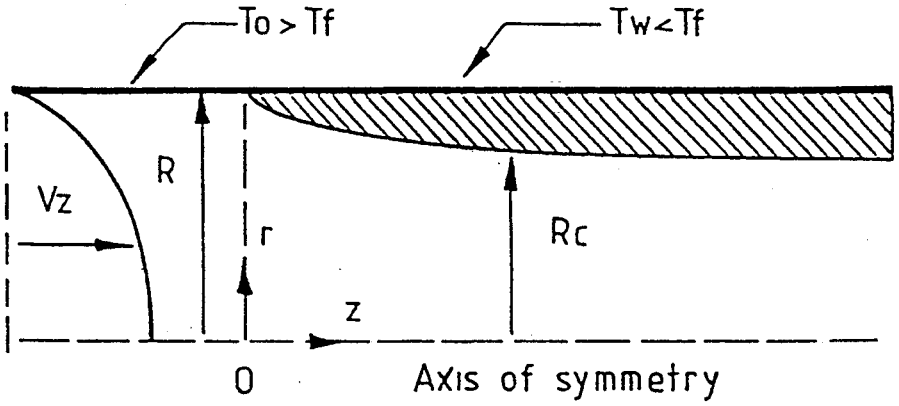

This invention relates to regulating the flowrate of a liquid furnace product and in particular to an apparatus for regulating such flow. While the invention will be described with reference to the metallurgical industry, the flowrate control technique is applicable to other industries which exhibit flowrate control problems similar to those stipulated.

BACKGROUND OF THE INVENTION

Flowrate control of liquid furnace products leaving metallurgical vessels and transport to the next process location in launders is very important to the overall performance of such vessels.

In the extractive metallurgy industry, tapping of furnaces is a very difficult, labour intensive and hazardous operation. Conventional tapping of furnaces is carried out periodically through a water cooled breast tapping hole. The hole is opened with an oxygen lance and closed by freezing in the tapping hole assisted by a clay plug or water cooled restrictor bars.

The problems associated with conventional tapping systems include delay in tapping due to difficulties in opening the taphole, no control of tapped liquid flowrate, wear and erosion of taphole due to oxy-lancing and difficulties in closing the taphole. As a result improved tapping techniques are required to overcome these difficulties. One such technique is the continuous tapping concept.

The development of continuous tapping began as early as 1899, when an external forebay for continuous tapping of iron blast furnaces was suggested. This idea was developed further to essentially the present day furnace/forebay relationship. Initially continuous tapping was limited to copper blast furnaces. The next development was the Roy type tapper in which the major differences from earlier developments were the use of an adjustable weir height by means of a deep V-notch and the installation of a burner in the forebay. The Roy type tapper is now conventional technology on lead blast furnaces.

The operation of the Roy type tapper is based on the principle of the liquid in the forebay counterbalancing the majority of the internal pressure of the furnace. The excess furnace pressure is the driving force for liquid flow out of the furnace. The advantages of the Roy type tapper over conventional tapping are the greater utilisation of the furnace for higher production and better control of composition than with intermittent tapping. However the Roy type tapper is an equilibrium system and cannot be controlled from a remote location. Consequently this type of tapper cannot handle a feed of variable composition and changes in flowrate must be made by weir or furnace head adjustments.

SUMMARY OF THE INVENTION

It is an object of the present invention to overcome the inadequacies of the Roy type continuous tapper.

Accordingly, the invention provides a method for for controlling the flow of a liquid material in a conduit, said conduit having a means to transfer heat from said liquid material, which method comprises:

a) initiating a flow of liquid material through the conduit;

b) measuring one or more of the following parameters:

i) inlet temperature of the liquid material entering the conduit, ii) flow rate of liquid material through the conduit, and iii) rate of heat transfer from the conduit;

c) determining, from the parameters measured in step (b) above, a rate of heat transfer from the liquid material flowing through the conduit which will provide a given flow rate of liquid material through the conduit, said rate of heat transfer being determined from a relationship between heat transfer rate from said liquid material and the flow rate through the conduit, (d) regulating the rate of heat transfer from said liquid material flowing through said conduit to provide the given flowrate through the conduit, wherein the heat transfer from said conduit causes a layer of material solidified from said liquid material to form on the inner surface of said conduit thereby constricting the passage for fluid flow through said conduit and changing the liquid flow accordingly.

Preferably, the heat transfer rate is regulated by changing the flowrate of coolant through a heat exchange jacket around said conduit.

The invention controls the flow of liquid furnace products by controlling the thickness of a solidified crust which forms in the taphole. Consequently, the flow of liquid furnace products can be controlled in the hostile environment where known control valves cannot be used.

In accordance with another aspect of the invention, there is provided an apparatus for controlling the flowrate through a conduit comprising (i) a means to transfer heat from said conduit said heat transfer causing a layer of material to solidify from said liquid to form a layer on the inner surface of said conduit, (ii) means to determine from a relationship between heat transfer rate and liquid flowrate in said conduit, a heat transfer rate which will provide a given flowrate of liquid material, and (iii) means to regulate the heat transfer rate to provide said given flowrate of liquid material.

In a preferred form, the heat transfer means comprises a heat exchange jacket around said conduit and the heat transfer rate is regulated by altering a coolant flow and/or coolant temperature through said jacket.

By varying the amount of heat transferred from the material in the conduit, the thickness of a crust which forms on the inner surface of the conduit can be regulated, thus increasing or decreasing the cross-sectional area available for flow of the molten liquid.

When liquid metal flows through a pipe, the liquid metal can be contaminated by metal or refractory eroded from the internal surface of the conduit. An additional advantage is that by controlling the metal flowrate, the internal surface of the heat exchanger will generally have a thin crust of solidified metal. This thin crust of metal protects the internal surface of the heat exchanger from the erosive effects of the flowing liquid metal thereby limiting contamination.

DESCRIPTION OF DRAWINGS AND PREFERRED EMBODIMENT

Figure 2:
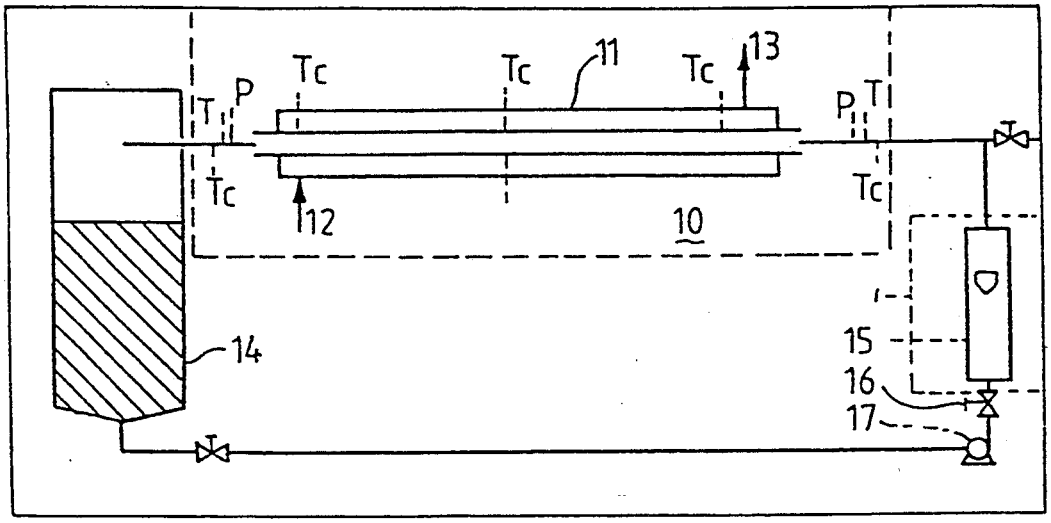
Figure 3:
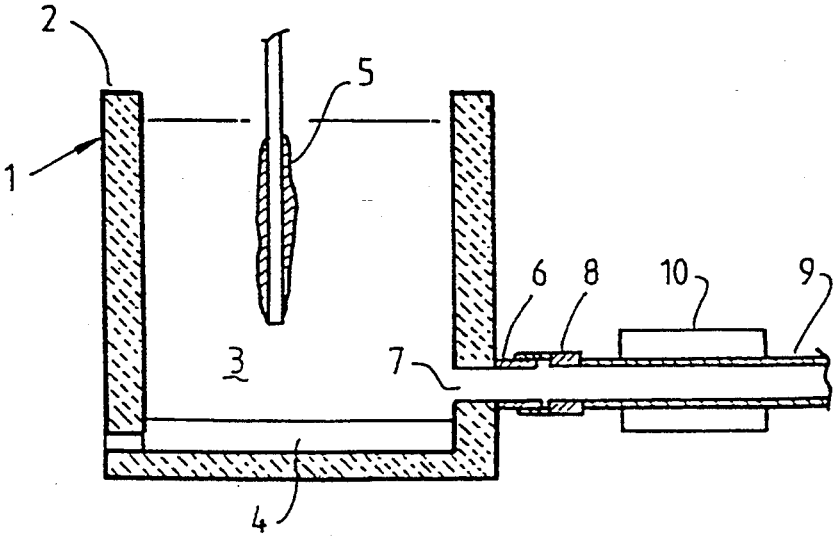
Figure 4:
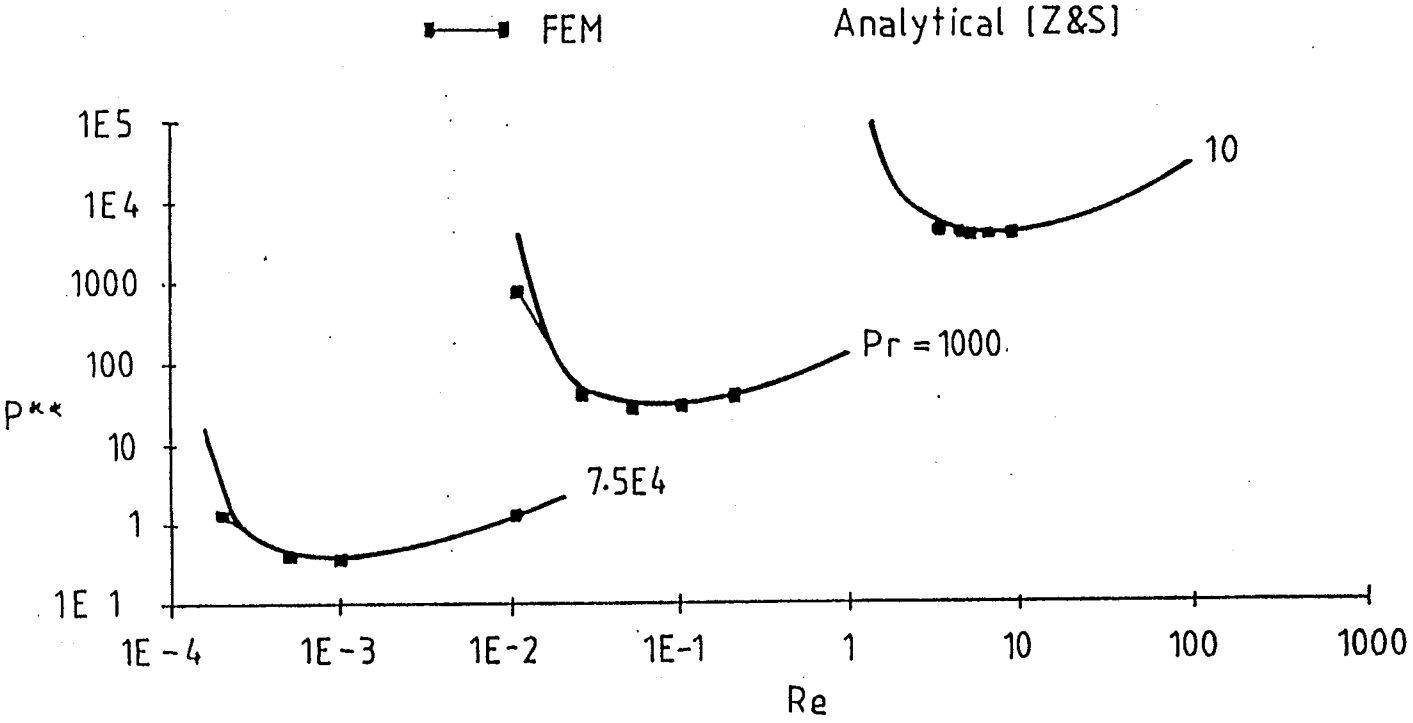
Figure 5:
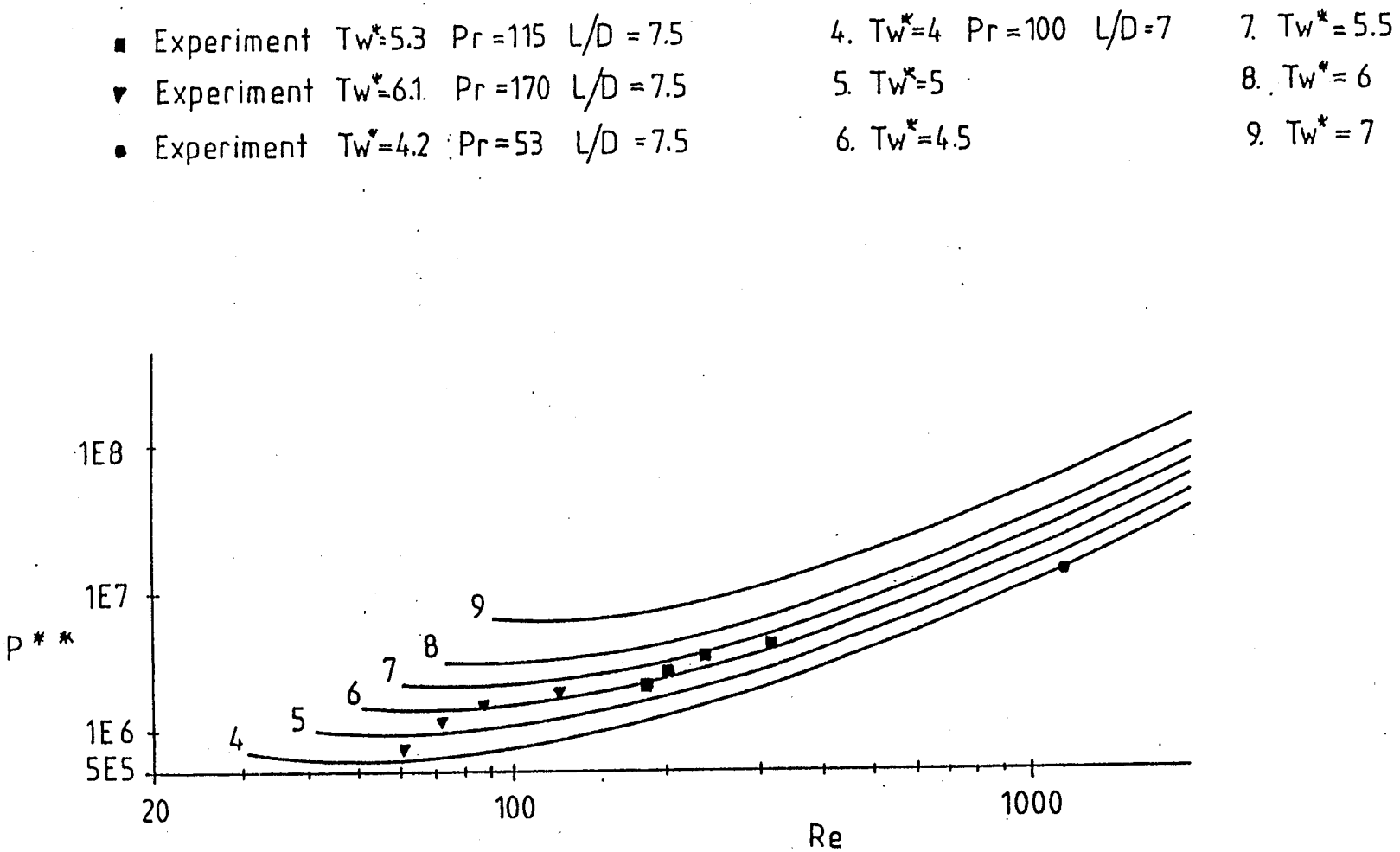
Figure 6:
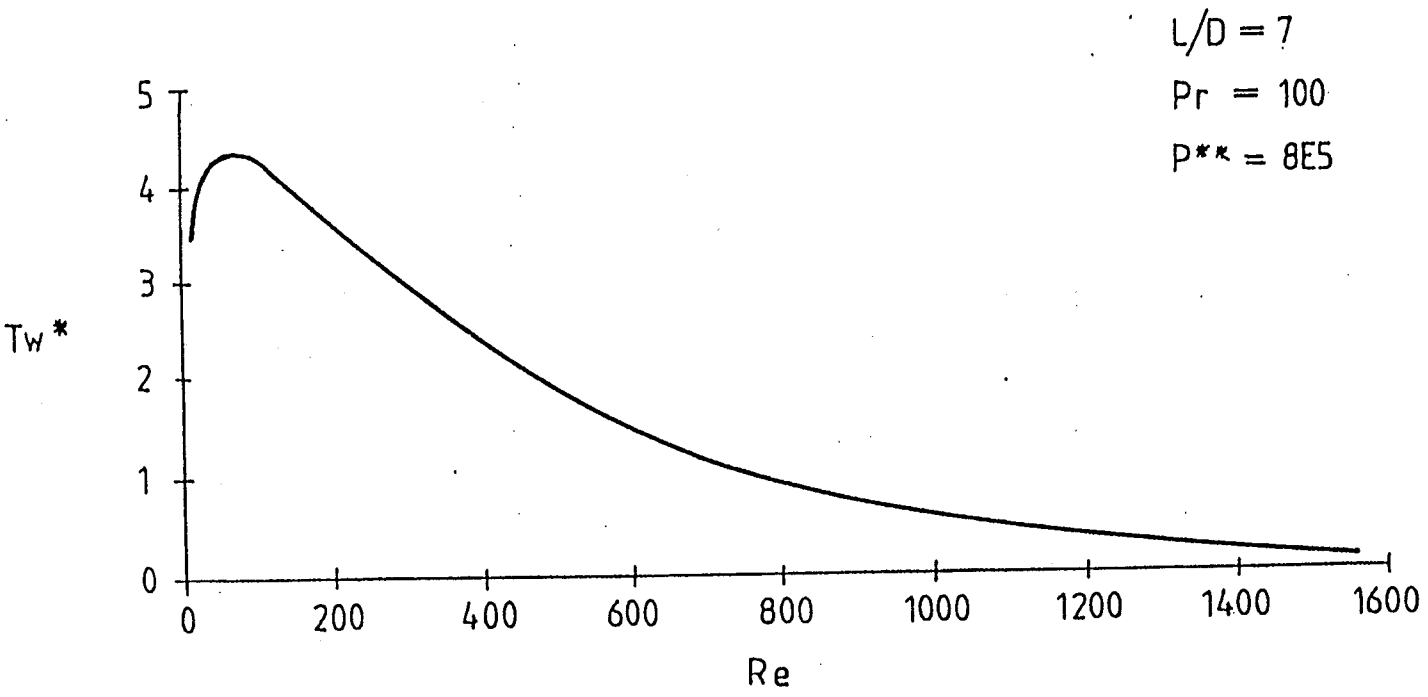
Figure 7:
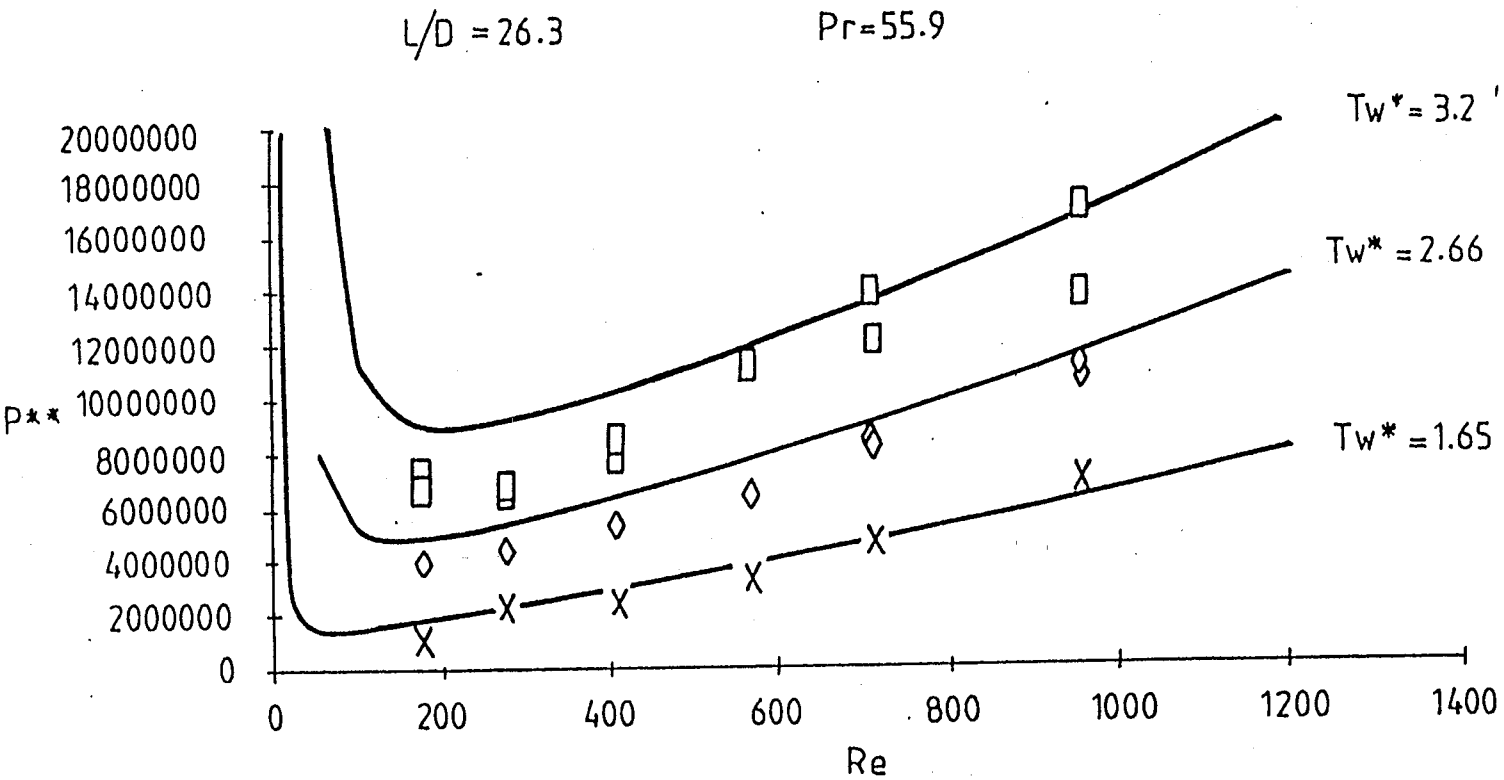

The foregoing and other features objects and advantages of the present invention will become more apparent from the following description of the preferred embodiments and accompanying drawings of which FIG. 1 is a sectional view at the thermal entrance of a tube with solidification, FIG. 2 is a schematic diagram of the physical modelling apparatus, FIG. 3 is a schematic diagram of the slag tapping system attached to a Sirosmelt reactor, FIG. 4 is a graph showing Dimensionless Pressure Drop versus Reynold's Number, FIG. 5 is a graph of Dimensionless Pressure Drop versus Reynold's Number, FIG. 6 is a graph of the Dimensionless freezing parameter (Tw*) versus Reynold's Number, and FIG. 7 is a graph showing Dimensionless Pressure Drop versus Reynold's Number.

FIG. 3 is a schematic view of the present invention used as a slag tapping system for a Sirosmelt reactor. The reactor 1 comprises a refractory lined vessel 2 containing molten slag 3 and a molten metal or matte layer 4. A lance 5 is submerged in the slag layer for the introduction of reactive gases. The vessel 2 has a graphite tube 6 cemented in front of taphole 7. An adaptor 8 is used to connect the graphite tube 6 to conduit 9 for transporting slag from the vessel 2. The conduit is fitted with a copper heat exchanger 10 and is cooled by a coolant passing through the heat exchanger. Heat is transferred from the liquid flowing in conduit 9 through the conduit wall, to the coolant. The coolant flow in the exchanger 10 is regulated by a flow valve (not shown) in response to the determined heat transfer rate from the liquid in the conduit.

To control the rate of heat exchange in accordance with the invention, it is necessary to determine a relationship for the steady-state freezing of a liquid flowing within a conduit.

For the problem schematically represented in FIG. 1, the circular tube wall is maintained at a uniform temperature, $T_w$, below the freezing temperature of the liquid, $T_f$. The liquid enters the tube at a uniform temperature, $T_o$, which is higher than $T_f$. For the purposes of developing a model the following assumptions were made.

1. Laminar flow
2. Steady-state
3. Negligible free convection and radiation losses
4. Negligible viscous dissipation
5. Constant wall temperature
6. Constant physical properties (Model can handle temperature dependent physical properties)
7. Newtonian liquid (Model can handle several types of liquids)
8. Parabolic velocity profile at entrance only
9. Zero heat flux at the downstream end of the pipe The governing equations for this situation are the continuity, momentum and energy equations in the liquid and the energy equation in the solid. The boundary conditions for the equations are:

1. No slip at the solid-liquid interface
2. Temperature at the tube wall is $T_w$,
3. Temperature at the solid-liquid interface is $T_f$
4. Under steady-state conditions, the heat flux across the solid-liquid interface must be continuous.

Where solidification with internal flow takes place the exact location of the solid-liquid interface is not known a priori. This has to be determined usually by an iterative procedure. An initial estimate is made of the interface location and the equations governing the solid and liquid regions are solved independently via a finite element program, satisfying all but one of the boundary conditions. The last boundary condition is that of continuous heat flux from solid to liquid. This condition is satisfied when the solid liquid interface location is found.

Nomenclature

Cp—Liquid heat capacity
D—Tube diameter
$k_s$—Solid thermal conductivity
$k_L$—Liquid thermal conductivity
L—Tube length
$\mu$—Liquid viscosity
Pe—Peclet number (PrRe)
Pr—Prandt number $\{Cp\mu/k_L\}$
P—Pressure drop in tube
P**—Dimensionless pressure drop $\{P/[\mu^2/(8R^2x\rho)]\}$
$R_c$—Location of solid-liquid interface
Re—Reynolds number $\{2V\rho R/\mu\}$
R—Tube Radius
r—Radial position
$\rho$—Density
$T_W$—Tube wall temperature
$T_o$—Liquid inlet temperature
$T_f$—Freezing and melting temperature
$T_W$*—Dimensionless freezing parameter $$\frac{k_s(T_f - T_w)}{k_L(T_o - T_f)}$$

V—Average velocity
$V_z$—Axial velocity
Z—Axial position

The control and design dimensionless parameters in accordance with the invention include the dimensionless freezing parameter(Tw*), the dimensionless pressure(P**), the Reynolds number (Re), the Peclet number(Pe), the Prandtl number (Pr) and the length to diameter ratio(L/D) (See Nomenclature). The dimensionless pressure is a design parameter and is a function of the furnace head, tube diameter, liquid viscosity and liquid density. The Peclet number is a measure of the significance of axial conduction. The Prandtl number is related to the liquid properties. The length to diameter ratio of the taphole is a taphole design parameter. The Reynolds number and the dimensionless freezing parameter are the control parameters. The dimensionless freezing parameter is the only parameter that can be manipulated to control the flowrate. The only variable that can be manipulated in the dimensionless freezing parameter without affecting the furnace operation is the tube wall temperature (a function of the coolant temperature and coolant flowrate).

The following examples were performed to evaluate the effectiveness of the model.

EXAMPLE 1

Slag tapping experiments were carried out on a SIROSMELT reactor as shown in FIG. 3. The slag tapping system is a water cooled copper heat exchanger attached to the tapping block of the SIROSMELT reactor. The reactor is oxy-lanced to start the flow and the copper heat exchanger is attached to the tapping block via a graphite adaptor. The slag flows through the heat exchanger and is cooled by the coolant forming a crust inside the heat exchanger. Measurements taken include 1. Initial furnace head
2. Flowrate of slag
3. Temperature of slag
4. Temperature profile in heat exchanger
5. Coolant flowrate
6. Coolant inlet and outlet temperatures

EXAMPLE 2

Laboratory experiments were carded out on the experimental apparatus shown in FIG. 2. The coolant used was water and the material flowing through the conduit was a hydrocarbon $C_{20}H_{42}$ (eicosane).

The heat exchanger 10 for conduit 11 comprises a heat exchange jacket 11 supplied with coolant which enters through inlet 12 and exits at outlet 13. For the sake of producing and verifying the mathematical model, eicosane was chosen as its melting point is low enough to allow the use of conventional flow control equipment. The eicosane is supplied from reservoir 14 and is controlled by rotameter 15, flow control valve 16 and pump 17. The sensors P, T and $T_c$ represent pressure manometers, thermometers and thermocouples respectively.

Experimental measurements taken include:

1. Eicosane flowrate
2. Pressure in and out of heat exchanger
3. Temperature of liquid Eicosane in and out of heat exchanger.
4. Conduit wall temperature
5. Eicosane crust thickness
6. Coolant inlet and outlet temperatures
7. Coolant flowrate.

The results of these experiments were used to compile FIG. 7.

FIG. 6 shows that for controlling the flowrate of slags there is a need to vary the dimensionless freezing parameter(Tw*) significantly. FIG. 6 also exhibits a maximum dimensionless freezing parameter value which is explained as being the maximum amount of cooling required for total tube blockage.

The results show that a relationship between the dimensionless freezing parameter and Reynold's number exists and is substantially as would be expected by mathematical modelling. This relationship allows the flowrate of the liquid through the conduit to be regulated by altering the flow or temperature of coolant to a surrounding heat exchanger jacket and thereby effect appropriate changes to the level of solidification in said conduit.

When tapping, the only control variable is the heat exchanger wall temperature. Consequently, the coolant operating temperature range is critical to the control of slag flowrates. With water as a coolant the flowrate of slag could not be controlled because the water operating temperature range is very small and is far removed from the freezing temperature. Thus Tw* is effectively constant throughout the operating range of water. This is due to the low thermal conductivity of the slag. As the slag crust builds, an insulating layer is formed which causes a large resistance to heat flow. Alternate coolants include liquid metals or an air-water mixture which provide a much larger operating range.

FIG. 4 is a plot of dimensionless pressure drop versus Reynolds number. These results are for a tube length to radius ratio of 2 and a dimensionless freezing parameter of 1. The most interesting feature of these plots is the minimum dimensionless pressure drop exhibited. As the Reynolds number increases the pressure drop increases above the minimum point, as usually happens with laminar flow in pipes. Below the minimum point the pressure drop versus flowrate curve has a negative slope. It can be shown that below the minimum point such flow curves are inherently unstable and generally any attempt to operate below the minimum will lead to total blockage for a fixed pressure system. The minimum point can therefore be used as an indicator for the onset of total tube blockage.

The results of the finite element(FEM) computations are compared in FIG. 4 with those calculated using the model reported in R. D. Zerkle and J. E. Sunderland, "The effect of liquid solidification in a tube upon laminar-flow heat transfer and pressure drop". *Journal of Heat Transfer*, (May 1968), 183–190. The results are found to be in good agreement. There is a minor difference which can be attributed to the entrance effects, the assumption of parabolic velocity, and the neglect of axial conduction by Zerkle and Sunderland. Axial conduction is unimportant for Peclet numbers greater than 100. For the slag experiments the Peclet number was greater than 1000 thus justifying neglect of the axial conduction. For ease of computation the slag experiments were compared with the predictions the model in the of Zerkle and Sunderland article.

The experimental results of slag tapping from a SIROSMELT reactor were compared against the model of Zerkle and Sunderland in FIG. 5. The data shows reasonable agreement with the model. Discrepancies between the model and the experimental data are attributed to the fact that slags do not have a single melting point, slag properties are temperature dependent, errors in the calculation of properties and to the experimental errors.

FIG. 7 shows the experimental results of the physical modelling experiments compared with the model of Zerkle and Sunderland. The agreement is good and is attributed to the material having a melting point at a specific temperature, accurately known temperature dependent properties and laminar flow at all locations along the conduit.

While the invention has been described in relation to a model developed for laminar flow of liquid through a tapehole or conduit, it would be readily apparent to those skilled in the art that a relationship may be developed and applied to turbulent flow without departing from the inventive concept.

This relationship can be established by mathematically modelling this regime and verifying the model or modifying the model following plant trials.

We claim:

1. A method for controlling the flow of a liquid material in a conduit, said conduit having a means to transfer heat from said liquid material, said liquid material being solidifiable by the transfer of heat therefrom, which method comprises the steps of:

a) initiating a flow of liquid material through the conduit;

b) measuring one or more of the following parameters associated with the liquid material flow:

i) inlet temperature of the liquid material entering the conduit, ii) flow rate of the liquid material through the conduit, and iii) rate of heat transfer from the conduit;

c) determining, from the parameters measured in step (b) above, a rate of heat transfer from the liquid material flowing through the conduit which will provide a given flow rate of liquid material through the conduit, said rate of heat transfer from the liquid material being determined from a relationship between the heat transfer rate from said liquid material and the flow rate through the conduit, d) regulating the rate of heat transfer from said conduit to obtain the heat transfer rate from said liquid material flowing through said conduit, as determined in accordance with step (c) above, that provides the given flow rate through the conduit, the heat transfer from said liquid material causing a layer of material solidified from said liquid material to form on the inner surface of said conduit to constrict the passage for fluid flow through said conduit and provide the given liquid material flow rate through the conduit.

2. The method in accordance with claim 1 wherein the means to transfer heat from said liquid material is a heat exchanger jacket positioned around said conduit and wherein heat transfer from said conduit is regulated by changing the flow rate and/or temperature of coolant through said heat exchange jacket.

3. The method in accordance with claim 2 herein said method further comprises monitoring one or more of the following parameters:

tube wall temperature of the conduit inlet temperature of the coolant fed to said heat exchanger jacket flowrate of the coolant in said heat exchanger jacket, and determining the rate of heat transfer from said liquid material flowing through said conduit which will provide the given flowrate from one or more of the measured parameters.

4. The method in accordance with claim 2 wherein the liquid material is a liquid furnace product.

5. The method in accordance with claim 1 wherein the heat transfer rate from the liquid material and the flow rate through the conduit is each represented by a dimensionless number and wherein the determination of the heat transfer rate from the liquid material employs said dimensionless numbers.

6. The method in accordance with claim 5 wherein the heat transfer rate in said relationship is represented by a dimensionless freezing parameter Tw* expressed by the formulae $$Tw^* = k_s(T_f - T_W)/k_1(T_o - T_f)$$

where $k_s$—solid thermal conductivity $k_l$—liquid thermal conductivity $T_f$—freezing and melting temperature $T_w$—tube wall temperature $T_o$—liquid inlet temperature.

7. The method in accordance with claim 5 wherein the flowrate in said relationship is represented by the Reynolds Number (Re) expressed by the formulae $$Re = 2V\rho R/\mu$$

where

V—average velocity $\rho$—density

R—tube radius $\mu$—liquid viscosity

8. An apparatus for controlling the flow rate of liquid material through a conduit, said liquid material being solidifiable by the transfer of heat therefrom, said apparatus comprising i) means for measuring one or more of the following parameters associated with the liquid material flow through the conduit (a) inlet temperature of the liquid material entering the conduit, (b) flow rate of the liquid material through the conduit, and (c) rate of heat transfer from the conduit;

(ii) means for transferring heat from said conduit, said heat transfer causing the liquid material to solidify and form a layer on the inner surface of said conduit to constrict the passage for fluid flow through said conduit and establish the liquid material flow rate through the conduit, (iii) means for determining from the parameters measured by said measuring means, a rate of heat transfer from said liquid material which will provide a given flow rate of liquid material through said conduit, said rate of heat transfer from the liquid material being determined from a relationship between the heat transfer rate and liquid flow rate in said conduit, and (vi) means for regulating the rate of heat transfer from said conduit to obtain the heat transfer rate from the liquid material that provides said given flow rate of liquid material through said conduit.

9. An apparatus in accordance with claim 8 wherein the heat transfer means is a heat exchange jacket around said conduit.

10. The apparatus in accordance with claim 9 further including means for controlling the flowrate and/or temperature of coolant through said heat exchange jacket.

11. The apparatus in accordance with claim 8 wherein the liquid material is a liquid furnace product.

12. The apparatus in accordance with claim 8 wherein said determining means is further defined as determining the heat transfer rate from the liquid material from a relationship between the heat transfer rate and liquid flow rate in which the heat transfer rate and liquid flow rate are each represented by dimensionless parameter numbers.

13. The apparatus in accordance with claim 12 wherein said determining means is further defined as determining the heat transfer rate from a relationship in which the heat transfer rate is represented by a dimensionless freezing parameter Tw* depicted by the formulae $$Tw^* = k_s(T_f - T_w)/k_1(T_o - T_f$$

where $k_s$—solid thermal conductivity $k_l$—liquid thermal conductivity $T_f$—freezing and melting temperature $T_w$—tube wall temperature $T_o$ - liquid inlet temperature.

14. The apparatus in accordance with claim 12 wherein said determining means is further defined as determining said heat transfer rate from a relationship in which the liquid flow rate in said relationship is represented by the Reynolds Number (Re) depicted by the formulae $$Re=2V\rho R/\mu$$

where

V—average velocity $\rho$—density

R—tube radius $\mu$—liquid viscosity.

15. The apparatus in accordance with claim 8 wherein said apparatus includes means coupled to said determining means to measure one or more of the following parameters:

temperature of the liquid, wall temperature of the conduit, inlet temperature of coolant, flowrate of coolant.

* * * * *